United States Patent [19]

Zodrow

[11] 4,092,207

[45] May 30, 1978

[54] BOTTLE LABELING MACHINE

[75] Inventor: Rudolf Zodrow, Dusseldorf, Germany

[73] Assignee: Jagenberg-Werke Aktiengesellschaft, Dusseldorf, Germany

[21] Appl. No.: 797,157

[22] Filed: May 16, 1977

Related U.S. Application Data

[63] Continuation of Ser. No. 754,869, Dec. 27, 1976, abandoned, which is a continuation of Ser. No. 597,276, Jul. 18, 1975, abandoned.

[30] Foreign Application Priority Data

Jul. 14, 1974 Germany ..... 2435568

[51] Int. Cl.[2] ..... B65C 9/16

[52] U.S. Cl. ..... 156/568; 118/231; 156/571; 156/DIG. 32; 271/33

[58] Field of Search ..... 156/568, 571, 567, 578, 156/DIG. 30, DIG. 31, DIG. 32; 271/33, 95, 115, 270; 118/220, 231, 236

[56] References Cited

U.S. PATENT DOCUMENTS

| | | | |
|---|---|---|---|
| 3,546,047 | 12/1970 | Dullinger | 156/568 X |
| 3,567,559 | 3/1971 | Dullinger | 156/571 |
| 3,923,589 | 12/1975 | Tavernier | 156/568 |

FOREIGN PATENT DOCUMENTS

| | | | |
|---|---|---|---|
| 2,325,244 | 12/1974 | Germany | 156/571 |

*Primary Examiner*—William A. Powell
*Assistant Examiner*—M. G. Wityshyn
*Attorney, Agent, or Firm*—Burgess, Dinklage & Sprung

[57] ABSTRACT

A bottle labeling machine is provided with a circular rotatable support about which there are positioned a gluing station, a magazine carrying a stack of labels and a gripper cylinder so that the pickup-transfer surface of a segment carried by said support successively receives glue, picks up a label and transfers it to the gripper cylinder. The segment is geared so that while carried by said support it rotates about its own axis in opposite direction from the support and from the gripper cylinder. This permits a particular machine capacity to be realized with fewer gluing segments.

1 Claim, 3 Drawing Figures

BOTTLE LABELING MACHINE

Figure 1:
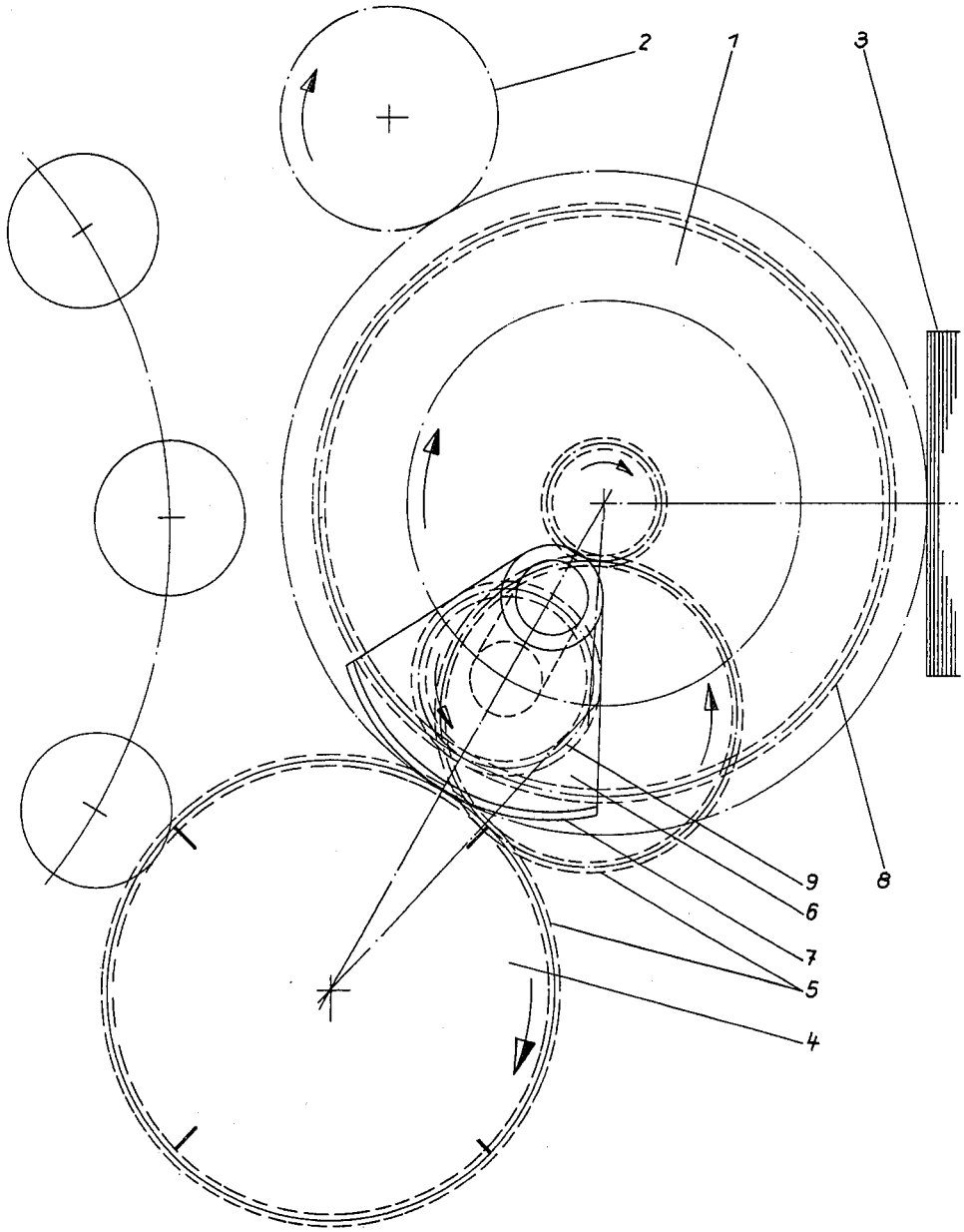

This is a continuation of application Ser. No. 754,869, filed Dec. 27, 1976, now abandoned, which was a continuation of application Ser. No. 597,276, filed July 18, 1975, now abandoned.

The invention relates to a labeling station of a labeling machine for objects, particularly bottles, with at least one gluing segment rotatably carried by a driven, rotating support and having an axis of rotation eccentrically mounted on the support between the center of the curvature of its cylindrically curved pickup-transfer surface and the axis of the support, and whose speed of rotation is accelerated and decelerated for the purpose of having its pickup-transfer surface roll across the surface of a rotating gripper cylinder.

In a known labeling station of this sort, the direction of rotation of the support is opposite to the direction of rotation of the gripper cylinder, while the peripheral speeds are approximately the same. Given these ratios, in order for the gluing segment to roll along the gripper cylinder, it is further necessary that the arc length corresponding to a division of the gripper cylinder is essentially equal to the arc length of the section of the support associated with a gluing segment. At a quadrisection of the gripping cylinder the division of the support is for example six or eight-fold. In order to allow the processing of labels which are as long as possible, the pickup-transfer surface of each gluing segment has a sharper curve, i.e. smaller radius of curvature, than the circle defined by the gluing segment as the support goes through one rotation. This sharper curve makes it necessary that, for the purpose of the rolling action, the gluing segment undergoes an oscillating motion during the rotation of the support.

A disadvantage of the known labeling station is that the division of the support and thus the number of gluing segments is fixed, so that the number of gluing segments is very high. A further disadvantage is the oscillating motion of the gluing segments.

The objective of the invention is to provide a labeling station which, while having the same capacity as that of the known labeling station, has fewer gluing segments, while the number of gluing segments on the support is variable and the motion of the gluing segments is more favorable.

With a labeling station of the sort indicated above, this objective is reached in that the support and the gripper cylinder have the same direction of rotation and the gluing segment or segments rotate in the opposite direction.

The invention is based on the discovery that in order to obtain a rolling between the gripper cylinder and the pickup-transfer surface of the gluing segment it is not necessary that the gluing segment support and the gripper cylinder rotate in opposite directions at about the same peripheral speeds, but that a perfect rolling can also be obtained if the direction of rotation of the gluing segment support is opposite to the direction of rotation of the gripper cylinder, while the rotation of the gluing segment or segments resulting from the gluing segment support can be compensated by an opposite rotation of the gluing segment or segments about its or their own axis. This results in a substantially larger division on the gluing segment support corresponding to the division of the gripper cylinder. By varying the rotational speed ratios between the gripper cylinder and the support, it is possible to increase or reduce the division of the support. Consequently, the invention allows fewer gluing segments, at an equal capacity, than there are required for the known apparatus. Moreover, the motion ratios for a high capacity of the machine are more favorable, because the gluing segments do not regularly have to change their direction of rotation.

Figure 2:
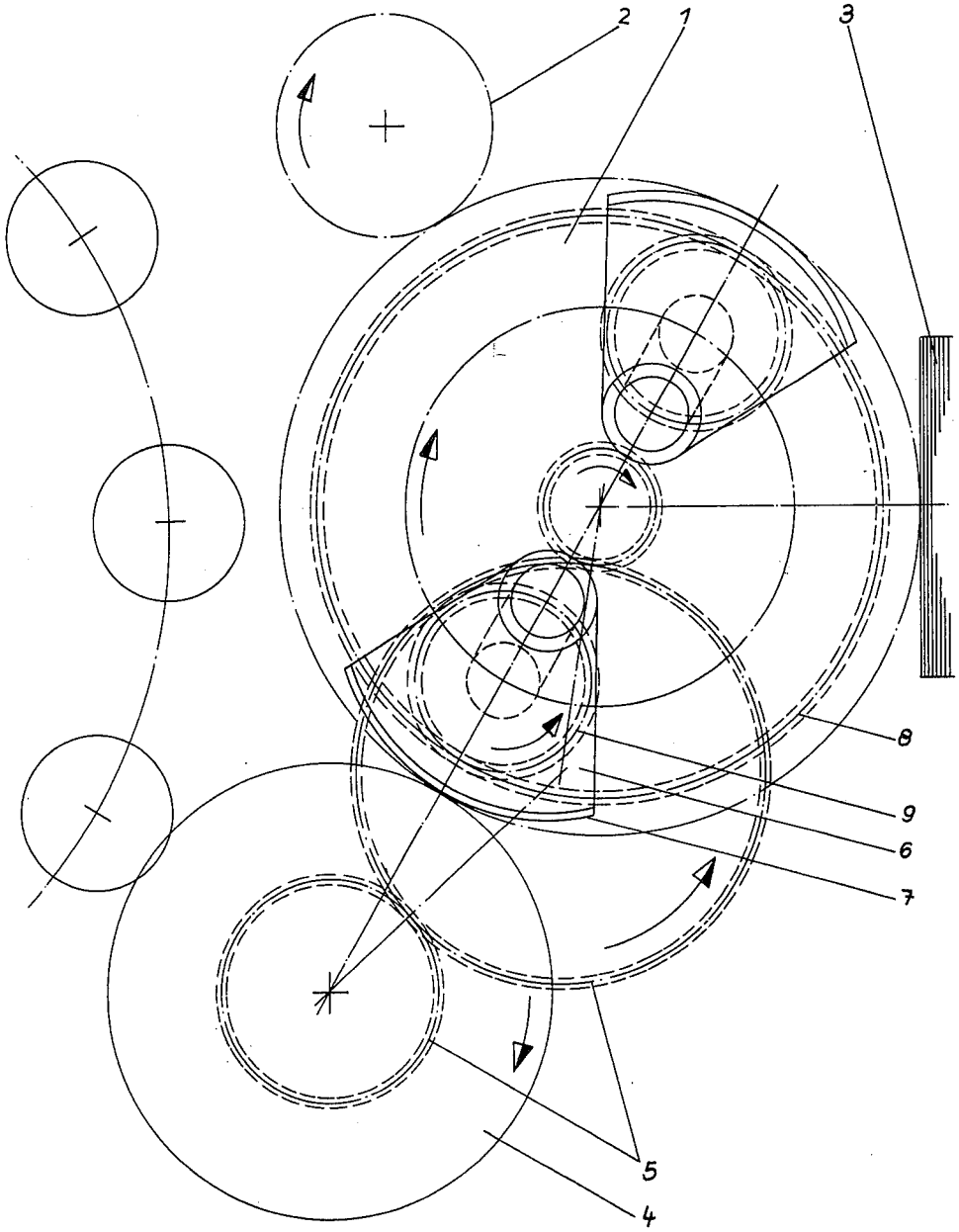
Figure 3:
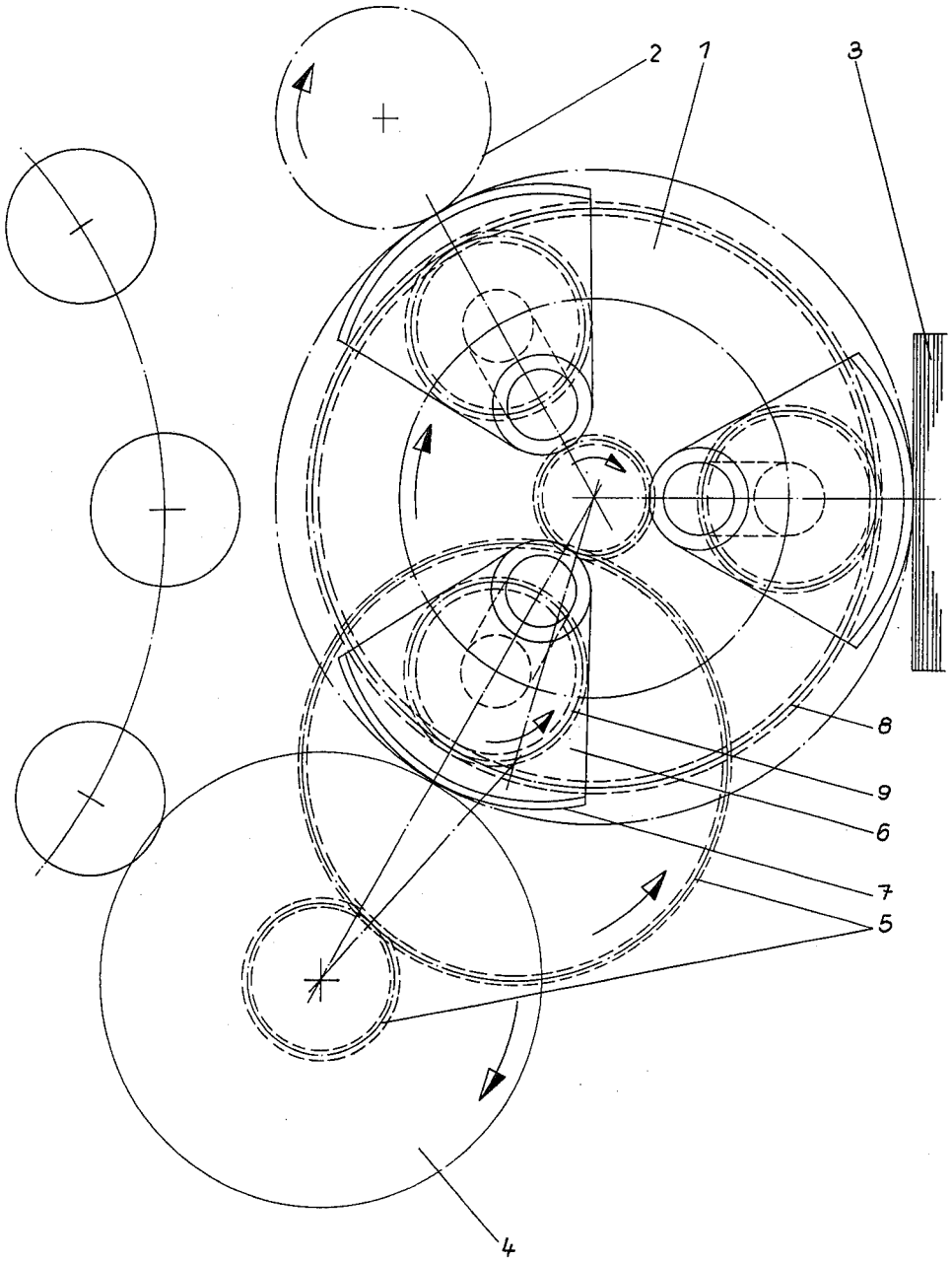

The invention is further explained below with reference to the accompanying drawings. The drawings show a diagrammatic top view of a labeling station provided in FIG. 1 with one gluing segment, FIG. 2 with two gluing segments, and FIG. 3 with three gluing segments.

Referring now more particularly to the drawings, the labeling station consists of a rotating gluing segment support 1 and, disposed in series along its periphery, stations, namely a glue roller 2, a label magazine 3 and a gripper cylinder 4. The gripper cylinder 4 is coupled to the gluing segment support 1 by way of a transmission gear 5, so that there is a specific transmission ratio between the support 1 and the gripper cylinder 4. By changing the transmission gear 5, this transmission ratio can be altered. In the first exemplified embodiment the transmission ratio is 1:4, in the second 1:2 and in the third 3:4.

The gluing segment support 1 has one, two, three or more gluing segments 6 evenly distributed. Each gluing segment 6 has a cylindrically curved pickup-transfer surface 7 whose radius of curvature is smaller than the distance of the shaft of the support 1 from the periphery of the gripper cylinder 4. The gluing segment 6 is supported on the gluing segment support 1 between its pickup-transfer surface 7 and the center of its curvature, symmetrically relative to its pickup-transfer surface 7. The drive is effected by means of a planet pinion 9 mating with a fixed sun wheel 8. When turning the gluing segment support 1 clockwise, this gear 8, 9 brings about a counterclockwise rotation of the gluing segment 6. In order to obtain a perfect rolling of the pickup-transfer surface, the rotation of a gluing segment is accelerated or decelerated by means of a known cam gear, not shown. When the gluing segment support 1 is rotating clockwise, the gear 5 effects a rotation of the gripper cylinder 4 which is also clockwise.

In the exemplified embodiment of the invention the selected directions of rotation and transmission ratios make a relatively small division of the gripper cylinder correspond to a large division of the gluing segment support. While on the one hand in the known apparatus the rolling was effected by the gluing segment support and the gripper cylinder which were rolling essentially against each other, the oscillating motion of the gluing segment having only a slight corrective effect, on the other hand such a rolling action between the gluing segment support and gripper cylinder is no longer the basis for the rolling process in the labeling station according to the invention, since the gluing segment support rotates in the same direction as the gripper cylinder. The rolling action of the invention is based on the gluing segment turning in a direction opposite to that of the rotation of the gripper cylinder. Due to the overlapping rotary motions of the gluing segment support and gluing segment, this gluing segment goes around practically the entire surface of the gripper cylinder, as it swings out forwardly and laggingly with the areas outside the center.

It will be appreciated that the instant specification and examples are set forth by way of illustration and not limitation, and that various modifications and changes may be made without departing from the spirit and scope of the present invention.

What is claimed is:

1. In a labeling machine such as a bottle labeling machine having a circular rotatable support, means for rotating said support, a gluing station, a label magazine station and a rotating gripper cylinder station disposed about said support, the improvement comprising a plurality of gluing segments carried by said support for rotation therewith and for rotation about their own axes, each segment having a pickup-transfer surface for successively contacting said gluing, magazine and gripper cylinder stations, said pickup-transfer surface comprising a segment of the surface of a cylinder and having a constant radius of curvature and the axis of rotation of said gluing segment being located between the center of curvature of said cylindrical transfer surface of the gluing segment and the center of the pickup-transfer surface itself to present a uniform geometric surface at every contact position for a given speed of rotation, means for effecting the rotating of said segments about their own axes to effect at least one complete revolution thereof during one revolution of the support, and means operatively connecting said support, said gripper cylinder and said segments to effect rotation of said support and gripper cylinder in the same direction with each segment rotating in the opposite direction, wherein the means operatively connecting the support, gripper cylinder and segments includes means receptive of any engaging pair of a set of changeable transmission gears each having a given diameter for effecting a desired diameter ratio of integral numbers to define a corresponding motion ratio of integral numbers between the support and the gripper cylinder, whereby for a given label length, the number of segments and therefore the capacity of the machine are dependent upon the diameter ratio and can be selected corresponding to the diameter ratio of the selected gears.

* * * * *

UNITED STATES PATENT AND TRADEMARK OFFICE

CERTIFICATE OF CORRECTION

PATENT NO. : 4,092,207

DATED : May 30, 1978

INVENTOR(S) : Zodrow

It is certified that error appears in the above-identified patent and that said Letters Patent are hereby corrected as shown below:

In Priority : Cancel "Jul. 14, 1974" and substitute therefor --Jul. 24, 1974-- .

Signed and Sealed this

*Fifth* Day of *December 1978*

[SEAL]

*Attest:*

RUTH C. MASON
*Attesting Officer*

DONALD W. BANNER
*Commissioner of Patents and Trademarks*